US007511208B1

(12) United States Patent
Kyser

(10) Patent No.: US 7,511,208 B1
(45) Date of Patent: Mar. 31, 2009

(54) SELECTABLE STRING CAPO

(76) Inventor: Milton Kyser, 15353 County Rd. 109, Kaufman, TX (US) 75142

( * ) Notice: Subject to any disclaimer, the term of this patent is extended or adjusted under 35 U.S.C. 154(b) by 0 days.

(21) Appl. No.: 12/029,755

(22) Filed: Feb. 12, 2008

(51) Int. Cl.
*G10D 3/00* (2006.01)

(52) U.S. Cl. ..... 84/318

(58) Field of Classification Search ..... 84/312 R, 84/318

See application file for complete search history.

(56) References Cited

U.S. PATENT DOCUMENTS

| | | | | |
|---|---|---|---|---|
| 1,094,038 | A | 4/1914 | Weaver | |
| 1,219,884 | A | 3/1917 | Thingstad | |
| 4,143,576 | A | 3/1979 | Nichols et al. | |
| 4,183,279 | A | 1/1980 | Shabram, Jr. | |
| 4,856,404 | A | 8/1989 | Hughes, Sr. | |
| 4,926,732 | A | 5/1990 | Collins et al. | |
| 5,101,706 | A | 4/1992 | Kilgore | |
| 5,623,110 | A | 4/1997 | Hoglund et al. | |
| 7,012,181 | B2 | 3/2006 | Tran | |
| 2004/0261600 | A1 * | 12/2004 | Silva | 84/318 |

* cited by examiner

*Primary Examiner*—Kimberly R Lockett
(74) *Attorney, Agent, or Firm*—John A. Thomas

(57) ABSTRACT

A selectable string capo allows a musician to engage one or more strings selectively while the capo is connected to a stringed instrument, while leaving one or more strings disengaged. The capo has at least one plunger and a finger lever allowing a musician to depress the plunger during performance so as to cause the plunger to engage one or more strings. When the finger lever is released, the plunger disengages from the string or strings.

6 Claims, 3 Drawing Sheets

SELECTABLE STRING CAPO

TECHNICAL FIELD

This disclosure capos (formally, capotastos) for stringed instruments.

BACKGROUND

Capos are used to engage the strings of a stringed instrument at a given neck position prior to performance, thus allowing a musician to raise the default pitch of a given set of strings without having to dedicate a finger to depressing the given set of strings. (In this application, to "engage" a string is to press the string downward against a fret or a fingerboard so that its pitch is changed.) For example, a musician may use a capo to depress all of the strings of a guitar at the first fret. A musician may also use a capo to selectively engage certain strings, while leaving other strings disengaged. For example, it is frequently advantageous for the low E string to be left disengaged while the other strings are engaged by a capo, commonly called "dropped-D tuning."

Conventional capos allow certain strings to be engaged when the capo is fitted to the neck of the instrument. However, it would be difficult or impossible for a musician to use a conventional capo to set a first set of strings as engaged by default and a second set of strings as disengaged by default, and then to selectively engage and disengage during a performance a subset of the second set of strings at the neck position occupied by the capo. The subject matter claimed here solves this problem.

DRAWINGS

DETAILED DESCRIPTION

Figure 1:
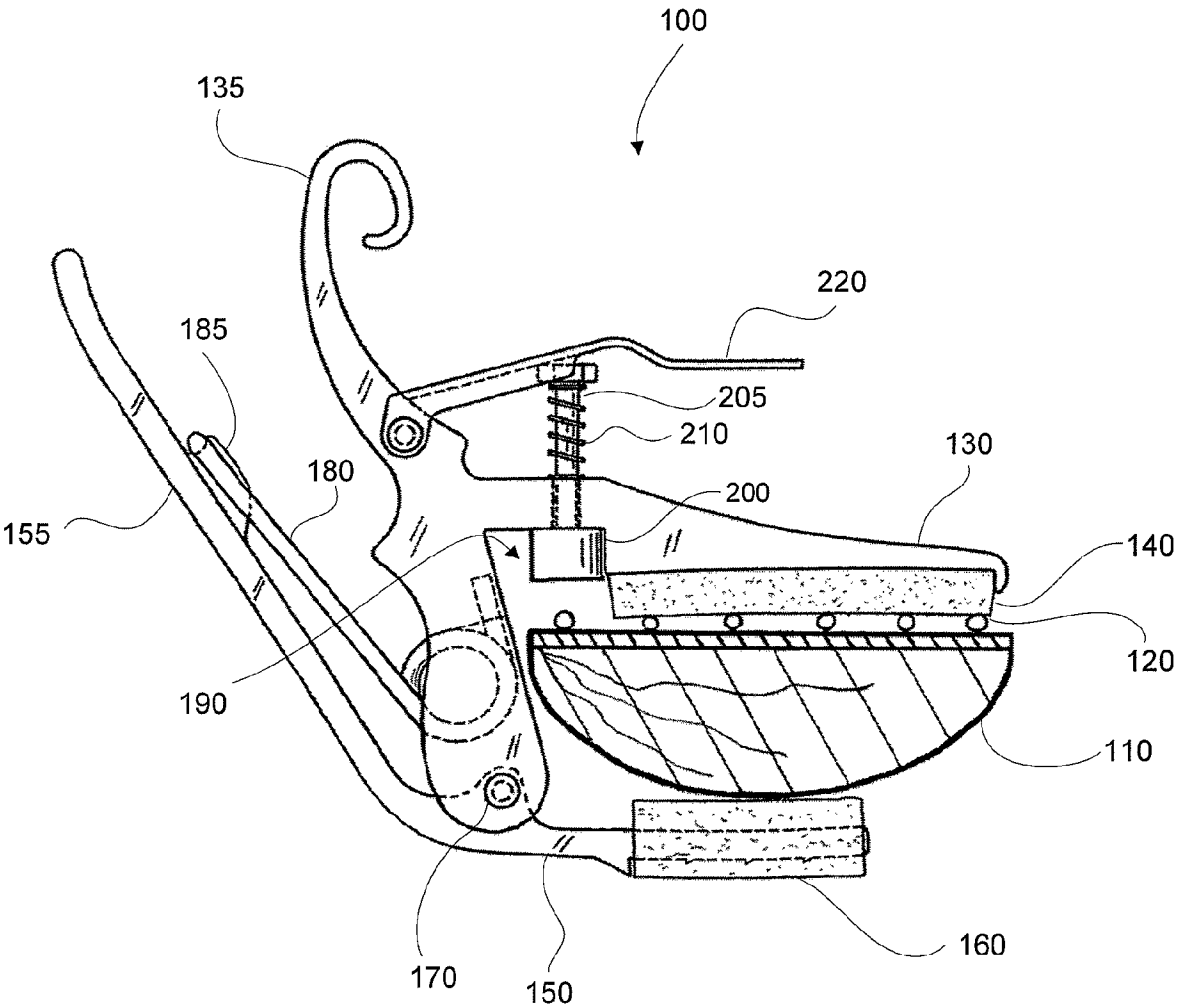
FIG. 1 shows an embodiment clamped across the neck of a stringed instrument.

FIG. 1 shows an embodiment of the selectable string capo (100), where the novel structure is a part of a spring-loaded clamp type capo. Although the structure of a spring clamp capo will be described here, the selectable string capo of this application could also be adapted to capos having other clamping mechanisms, such as elastic bands or screw-tightened clamps. Such capos are conveniently made from sections of extruded metal such as aluminum, although they could be constructed from hardwoods or rigid plastics.

Figure 2:
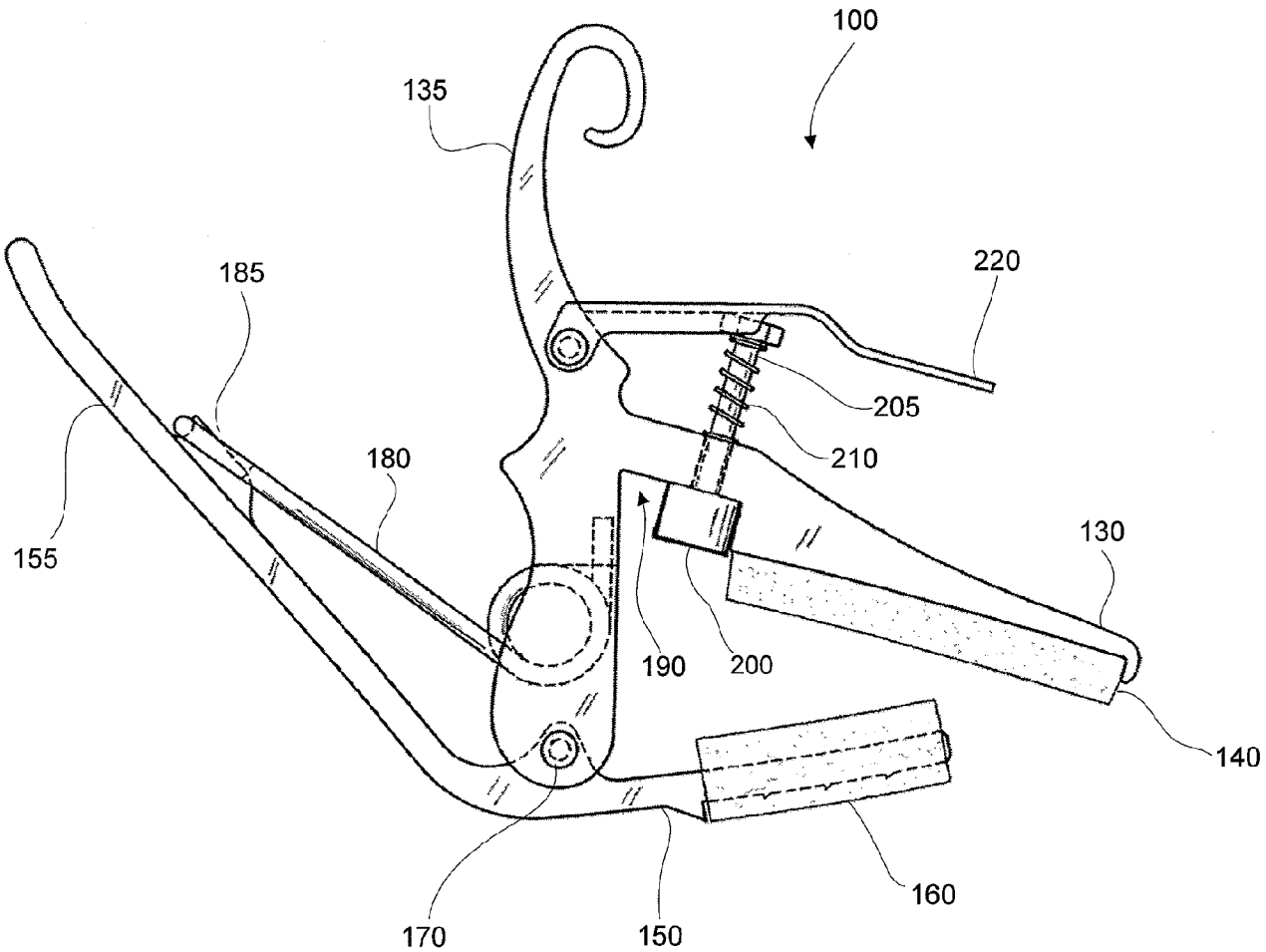
FIG. 2 shows an embodiment without the presence of an instrument neck.

Referring to FIG. 1, a capo (100) is clamped across the neck (110) of a stringed instrument. The neck (110) and the strings (120) of the instrument are shown in cross-section. The capo (100) has an upper clamp arm (130); one end of the upper clamp arm (130) has a first pad (140) for pressing on the instrument strings (120) and an opposite end that functions as a handle (135). The capo (100) has a lower clamp arm (150), which in turn has a handle (155) and a second pad (160) for pressing against the bottom of the neck (110 of the instrument. The upper clamp arm (130) and the lower clamp arm (150) pivot together about a pivot (170). The pivot (170) may be a bolt or rivet. As shown in FIGS. 1 and 2, an arm spring (180), preferably a torsion spring, engages the upper clamp arm (130) and the lower clamp arm (150) and urges the respective pads (140, 160) together about the pivot (170). In the capo (100) shown, the arm spring (180) is retained on the lower clamp arm (150) by engaging a projection (185) on the lower clamp arm (150). The upper arm handle (135) and the lower arm handle (155) may be squeezed together against the force of the arm spring (180) to open the capo (100) to receive the neck of an instrument.

Figure 3:
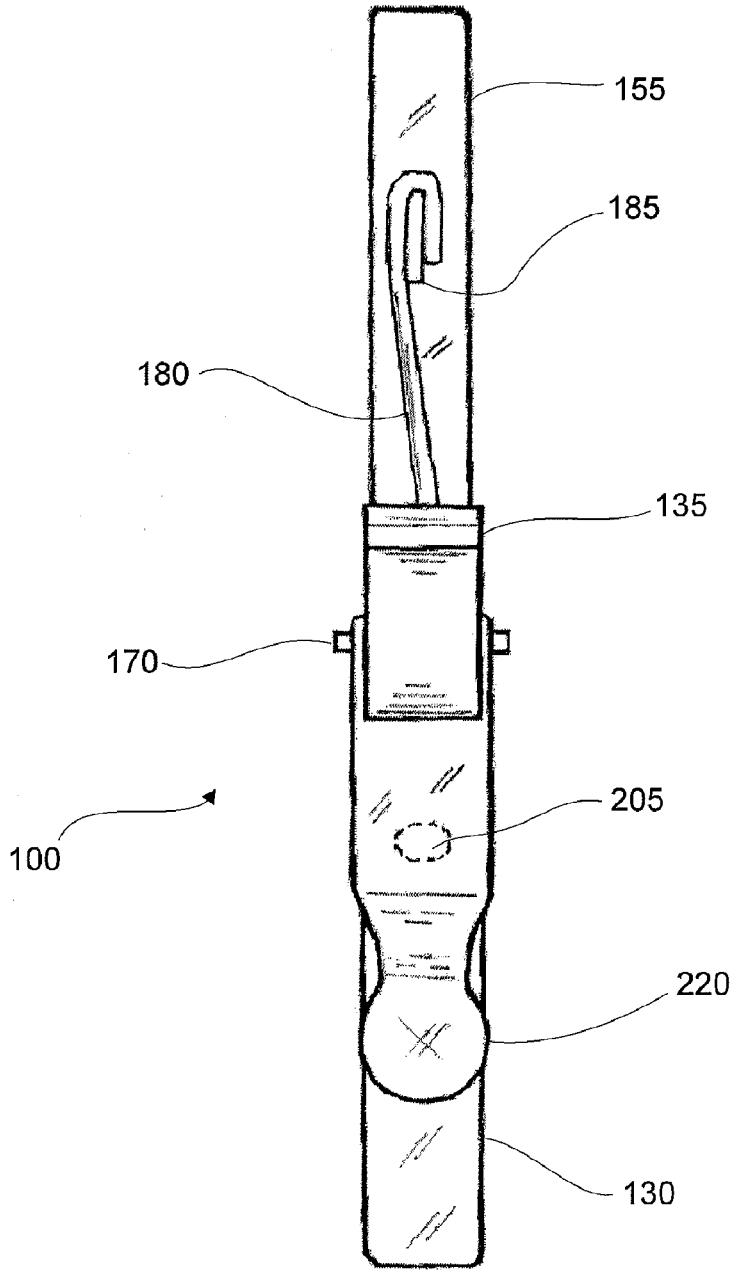
FIG. 3 shows a top view of the embodiment in FIG. 2.

FIGS. 1 and 2 show a cutout (190) in the upper clamp arm (130). A plunger (200) is positioned in the cutout. The plunger (200) has a shaft (205) passing through the upper clamp arm (130). The plunger shaft (205) engages a finger lever (220) pivoting from the upper handle (135). The plunger (200), preferably padded at the end in the cutout (190), is urged upward by a coaxial spring (210) against the finger lever (220). FIG. 3 shows a top view of the finer lever (220) and the position of the plunger shaft (which may be a bolt having a head), under the finger lever (220). When the finger lever (220) is pressed by a musician, the plunger (200) is forced downward to engage the string over which it is positioned.

For example, if the selectable string capo shown in the figures is clamped to a guitar neck (110) at the second fret, the pitch of all strings (120) except the lower E string will be raised a whole note. In effect, then dropped-D tuning is achieved at the new relative pitch when the plunger (200 is raised by the string (210). When the plunger (200) is depressed by the musician, the lower E string is pressed to the fret, and the resulting relative tuning of the instrument is that of the normal guitar.

In other embodiments, the selectable string capo (100) may have the cutout (190) and plunger (200) positioned over a different string than that shown in the figures. Or, the plunger (200) may engage more than one string when depressed by the finger lever (220). Or, the selectable string capo (100) may have a plurality of cutouts (or one enlarged cutout) (190) with a corresponding plurality of plungers (200) to be engaged by the finger lever (220).

I claim:

1. A capo comprising:

an upper clamp arm for engaging the strings of a stringed instrument;

a lower clamp arm for engaging the neck of the stringed instrument;

the upper clamp arm having a cutout;

the cutout situated over the location of at least one string;

a plunger disposed within the cutout;

the plunger connected to a shaft;

the shaft moveable through the upper clamp arm;

a plunger spring; the plunger spring urging the plunger away from the string over which the cutout is located;

a finger lever;

the finger lever engaging the end of the shaft opposite to the plunger;

so that the plunger will selectively engage or disengage the string over which the cutout is located when the finger lever is respectively pressed and released.

2. The capo of claim 1 where the finger lever is pivotably connected to the upper clamp arm of the capo.

3. The capo of claim 1 where the upper clamp arm and the lower clamp arm are pivotably connected.

4. The capo of claim 2, further comprising:

an arm spring;

the arm spring connected between the upper clamp arm and the lower clamp arm, so that the upper clamp arm and the lower clamp arm are urged together.

5. The capo of claim 1 where the upper clamp arm and the lower clamp arm have padding.

6. The capo of claim 1 where the plunger spring is a spring coaxial with the shaft.

* * * * *